US006378449B1

(12) United States Patent
Leblanc et al.

(10) Patent No.: US 6,378,449 B1
(45) Date of Patent: Apr. 30, 2002

(54) COMPETITION OR CRUISER SAILBOAT WITH IMPLANTED MAST

(76) Inventors: Gilbert Leblanc, 17, rue D'Aurigny, F-50440 Beaumont Hague; Halvard Mabire, Le Foc de Haut, F-50340 Saint Christophe du Foc; Franck De Rivoyre, Les Jardine de Charlotte, Residence Val d'Azur 115, allee des Palmiers, F-06560 Valbonne; Benjamin Capéran, 56400 Plougoumelen, Tour Er Lann, all of (FR)

( * ) Notice: Subject to any disclaimer, the term of this patent is extended or adjusted under 35 U.S.C. 154(b) by 0 days.

(21) Appl. No.: 09/530,410

(22) PCT Filed: Oct. 29, 1998

(86) PCT No.: PCT/FR98/02316

§ 371 Date: Jun. 5, 2000

§ 102(e) Date: Jun. 5, 2000

(87) PCT Pub. No.: WO99/22982

PCT Pub. Date: May 14, 1999

(30) Foreign Application Priority Data

Oct. 30, 1997 (FR) ..... 97 13635

(51) Int. Cl.[7] ..... B63B 15/00
(52) U.S. Cl. ..... 114/91

(58) Field of Search ..... 114/89, 90, 91, 114/92, 93, 39.21, 39.32

(56) References Cited

U.S. PATENT DOCUMENTS

| | | | | | |
|---|---|---|---|---|---|
| 1,375,400 | A | * | 4/1921 | Ljungstrom | 114/91 |
| 4,005,669 | A | * | 2/1977 | Klemm | 114/91 |
| 4,345,535 | A | | 8/1982 | Ross | |

FOREIGN PATENT DOCUMENTS

| | | |
|---|---|---|
| FR | 2 579 557 | 10/1986 |
| FR | 2 613 685 | 10/1988 |
| FR | 2 749 270 | 12/1997 |
| GB | 2 151 195 A | 7/1985 |
| WO | WO 89/07546 | 8/1989 |
| WO | WO 99/22982 | 5/1999 |

* cited by examiner

*Primary Examiner*—Stephen Avila
(74) *Attorney, Agent, or Firm*—Baker & Daniels

(57) ABSTRACT

The invention concerns a competition or cruiser sailboat comprising a hull (1) closed by deck (2), and wherein is implanted the lower end of a mast (4) bearing the rigging, characterized in that the mast (4) is a tilting mast without side stays, mounted pivoting in particular on bearings about a substantially horizontal axis (x-x') of the hull (1) such that, whatever the weather conditions, its center of gravity (G) can be placed in the wind, in the sailboat center of rotation, and the rigging plane perpendicular to the air streams.

7 Claims, 3 Drawing Sheets

COMPETITION OR CRUISER SAILBOAT WITH IMPLANTED MAST

BACKGROUND OF THE INVENTION

The present invention relates to a competition or cruiser sail-boat comprising a hull which is closed by a deck and in which the lower end of a mast carrying the sails is implanted.

In recent years there has been a substantial development in yachting and many individuals have already acquired or envisage acquiring a sail-boat.

The current yachting fleet is principally constituted, in particular in the field of medium-size craft, by mono-hull habitable sail-boats which are relatively inexpensive and largely satisfactory from the point of view of comfort and the possibilities of interior fitting-out.

The rigging of these sail-boats is usually constituted by a mast and shrouds, the role of which is to support and strengthen the mast.

The appearance of sail-boats of which the hull is no longer made of wood but of materials known as composites, in particular laminated plastics (epoxy carbon fibre), has led to sail-boats being proposed to the public in which the mast is implanted directly in the hull, which enables the side shrouds to be dispensed with and therefore the structure of the boat to be substantially simplified.

However, the consequence of such a design is a substantial increase in the weight of the rigging, given that the mast must thus be substantially heavier with a very high centre of gravity; this has a detrimental effect and greatly impairs the speed of the boat, in particular when the wind is strong.

This situation is more especially disadvantageous as more and more yachtsmen, influenced especially by the great transoceanic races, are looking for sports performance and therefore wish to acquire a sail-boat which is the fastest possible.

SUMMARY OF THE INVENTION

The object of the present invention is to propose a competition or cruiser sail-boat having an implanted mast, of the above-mentioned type, which is capable of meeting those requirements.

Such a sail-boat is characterised in that the mast is a tilting mast which is free from side shrouds and which is mounted to pivot, especially on bearings, about at least one substantially horizontal axis, that axis coinciding with the longitudinal axis of the hull; owing to this capacity for port-starboard tilting, regardless of the weather conditions, the centre of gravity of the mast can be placed in the wind, at the centre of rotation of the sail-boat, and the plane of the sails can be placed perpendicular to the airstreams.

According to a preferred feature of the invention, the mast is a turning and tilting mast mounted to pivot about three axes which are perpendicular to one another, namely an upright axis, the port-starboard tilting axis and a substantially horizontal axis perpendicular to the tilting axis, and can therefore be oriented in all directions.

According to the invention, such a mast may advantageously be mounted on a bearing of the ball-and-socket joint type secured at the level of the deck of the sail-boat; at the same time, its foot can slide on a rail, preferably of carbon fibre, inserted at the bottom of the hull.

This configuration on the one hand enables the righting moment of the sail-boat to be increased, as a result of the displacement of the centre of gravity of the mast into the wind thereof and, on the other hand, enables the aerodynamic propulsive force to be increased given that the mast can be oriented perpendicularly to the airstreams, and even enables a slight lifting effect to be developed. At the same time, there is a reduction in the drag, bearing in mind the absence of shrouds.

According to another feature of the invention, the mast cooperates, by way of its lower end, with manoeuvring members enabling it to be oriented and locked in a determined position.

Such adjustment can be carried out manually by means of control levers made available to the helmsman.

It would also be possible to provide for automatic control of the orientation of the mast from devices for detecting the position of the sail-boat which cooperate with an electronic servo-control system known per se.

It should be noted that, in the course of sailing, the forces exerted on the mast are absorbed by the bearing having a ball-and-socket joint and by the manoeuvring members.

According to a non-limiting feature of the invention, the mast can, respectively, tilt by an angle of ±45° about a substantially horizontal axis coinciding with the longitudinal axis of the hull, and, optionally, about an axis which is also substantially horizontal and which is perpendicular to the longitudinal axis.

According to another non-limiting feature of the invention, the mast can tilt by an angle which may exceed ±90° about a substantially vertical axis perpendicular to the longitudinal axis of the hull.

It has been established that this ability of the mast to tilt about each of its three pivoting axes is sufficient for it to adapt to all sailing conditions (listing, pitching or rolling).

According to another feature of the invention, the mast has a cross-section in the shape of a wing; such a configuration is particularly advantageous from an aerodynamic point of view, given that it brings about a substantial reduction in the drag or resistance to advance, and, at the same time, from a structural point of view, in respect of the rigidity of the mast; the mainsail is then mounted in such a manner that it stresses the mast according to its greatest inertia.

It should be noted that, according to the invention, the lateral rigidity of the mast is ensured exclusively by the mast, in particular if it has a wing-shaped profile. The longitudinal rigidity can, for its part, be "strengthened" by the halyards of the sails returned to the rear or a longitudinal front shroud having a post (stay), which shroud is stiffened by a runner and tackle if this stay is used as a support for the hoist of a head sail, for example.

BRIEF DESCRIPTION OF THE DRAWINGS

The features of the sail-boat to which the invention relates will be described in more detail with reference to the appended drawings in which.

It should be noted that the Figures represent, by way of example, a tilting and turning mast articulated to a ball-and-socket joint; although this configuration is preferred it should not, of course, be regarded as limiting the invention.

DESCRIPTION OF THE PREFERRED EMBODIMENT

Figure 1:
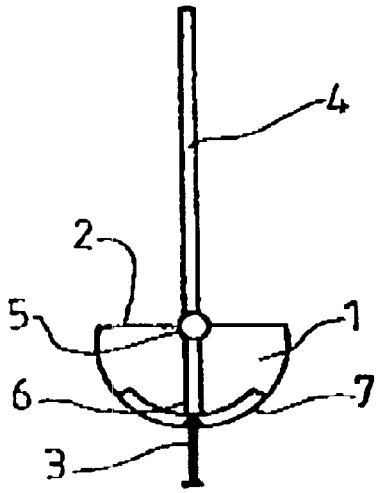
FIG. 1 is a diagrammatic view of a sail-boat according to the invention.

According to FIG. 1, the sail-boat according to the invention is basically constituted by a hull 1 which is closed by a deck 2 at its upper portion and which is extended downwards by a keel 3, in such a manner as to ensure that the boat floats, and by a mast 4 implanted in the hull 1 and carrying the sails (not shown).

Figure 1A:
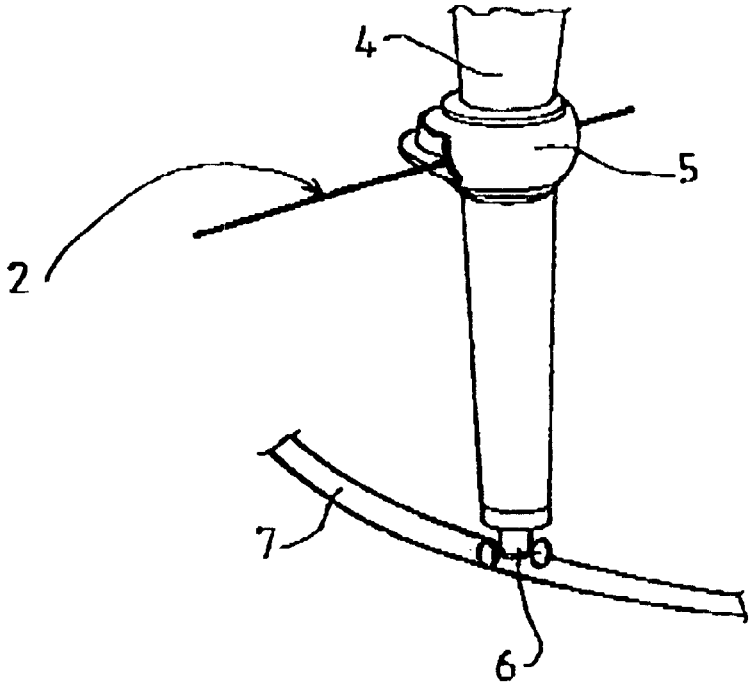
FIG. 1*a* is a detailed view of the ball-and-socket joint and of the foot of the mast.

To be more precise, and according to FIG. 1*a*, the mast 4 is mounted on a bearing of the ball-and-socket joint type 5 secured at the level of the deck 2 and slides, by way of its lower end 6, on a carbon fibre rail 7 inserted at the bottom of the hull; manoeuvring members (not shown) enable the mast 4 to be oriented and locked in various angular positions from the cockpit.

Figure 2A:
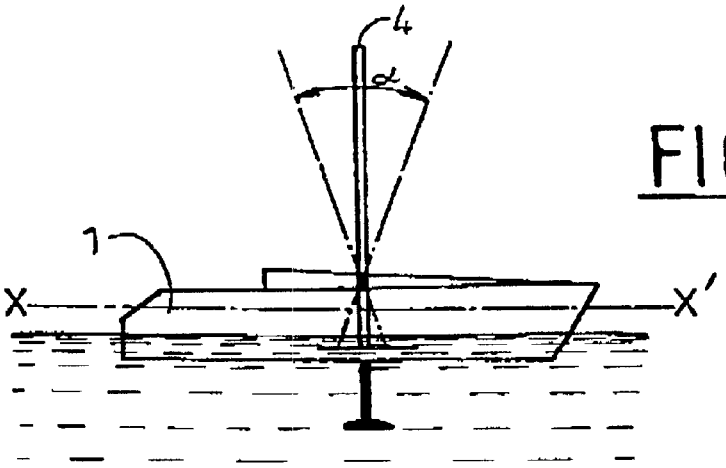
FIGS. 2*a*, 2*b* and 2*c* are diagrams representing the various pivoting axes of the mast.
Figure 2B:
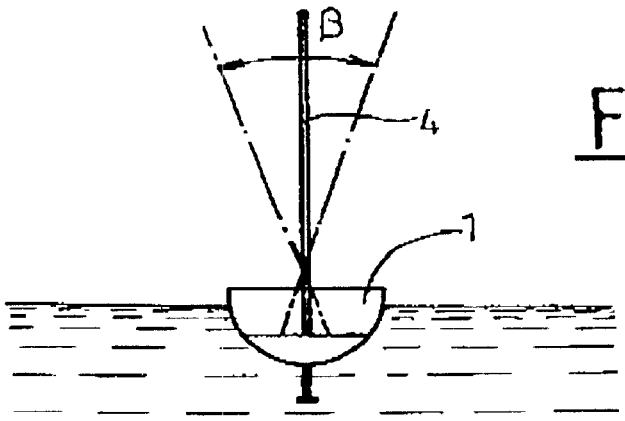
Figure 2C:
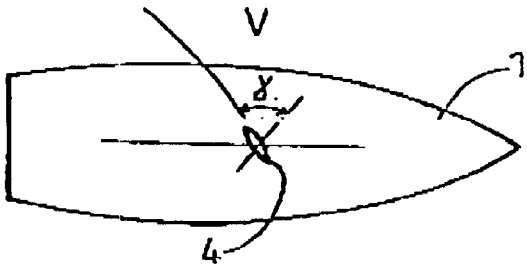

According to FIGS. 2*a*, 2*b* and 2*c*, the mast 4 can, respectively, tilt by an angle $\alpha$ about an axis perpendicular to the longitudinal axis x-x' of the hull 1 (FIG. 2*a*), by an angle $\beta$ about an axis coinciding with the longitudinal axis x-x' (FIG. 2*b*) or by an angle $\gamma$ about a substantially vertical axis perpendicular to those two pivoting axes (FIG. 2*c*).

The maximum tilting angles $\alpha$, $\beta$ are both 45° in one direction or another, while the maximum angle $\gamma$ may optionally even exceed ±90°.

According to FIG. 2*c*, the mast 4 has a cross-section in the shape of a wing, which ensures maximum lateral rigidity bearing in mind the fact that the mainsail v represented diagrammatically stresses the mast according to its greatest inertia.

Figure 3A:
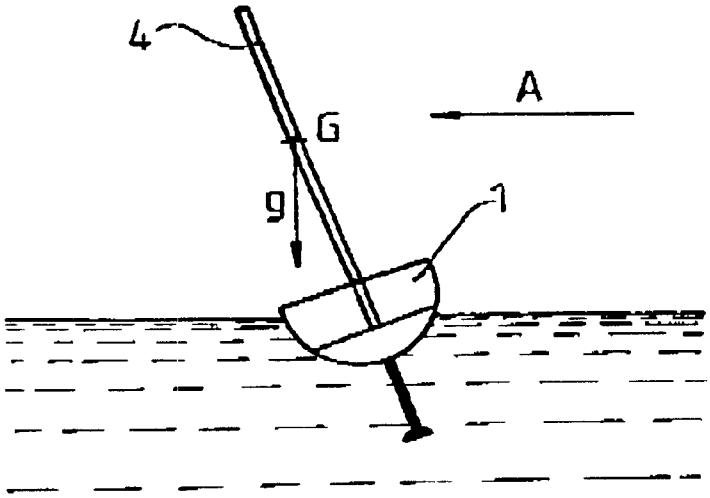
FIGS. 3*a* and 3*b* represent, respectively, a conventional sail-boat and a sail-boat according to the invention, which are underway.

According to FIG. 3*a*, when there is a wind directed according to arrow A, the sail-boat is inclined laterally (listing), while of course entraining the mast 4 in that movement; the advance of the sail-boat is then impaired by the gravity g of the mast 4 which acts vertically from the centre of gravity G of the mast, by the reduction in the projected surface area of the sails onto a vertical plane, and by the orientation of the airstreams which form an angle of from 70 to 75° with the sails.

Figure 3B:
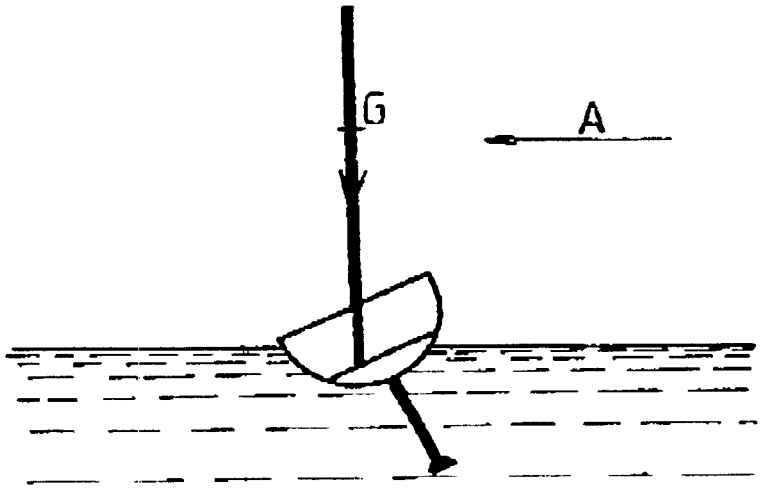

According to FIG. 3*b*, the invention enables that disadvantage to be removed owing to the orientation into the wind of the mast 4 which enables the centre of gravity G to be displaced to the centre of rotation of the boat owing to the pivoting of the mast and thus enables all of the surface area of the sails to be presented as a surface projected onto a vertical plane and permits an orientation of the airstreams at 90° to the sail.

What is claimed is:

1. A sailboat comprising:

a hull;

a deck which closes an upper portion of the hull; and a mast having a lower end, which lower end is implanted in the deck, the mast being tiltable, free from side shrouds, and mounted to pivot at least about an upright rotating axis and about a port-starboard tilting axis which coincides with a longitudinal axis of the hull so that, regardless of the weather conditions, a center of gravity of the mast can be positioned into the wind at a center of rotation of the sailboat and a plane of sails coupled to the mast can be positioned perpendicular to airstreams of the wind.

2. A sailboat according to claim 1, wherein the mast is mounted on a bearing of the ball-and-socket joint that is secured at a position level to the deck of the sailboat.

3. A sailboat according to claim 1, wherein the lower end of the mast cooperates with maneuvering members which enable the mast to be oriented and locked in a determined position.

4. A sailboat according to claim 1, wherein the mast can tilt by an angle of 45° about the port-starboard tilting axis.

5. A sailboat according to claim 1, wherein the mast can tilt by an angle which may exceed ±90° about the upright rotating axis.

6. A sailboat according to claim 1, wherein the mast has a cross-section in the shape of a wing.

7. A sailboat according to claim 1, wherein the lower end of the mast slides on a rail provided on a bottom portion of the hull.

* * * * *

UNITED STATES PATENT AND TRADEMARK OFFICE

CERTIFICATE OF CORRECTION

PATENT NO. : 6,378,449 B1
DATED : April 30, 2002
INVENTOR(S) : Gilbert LeBlanc et al.

It is certified that error appears in the above-identified patent and that said Letters Patent is hereby corrected as shown below:

Column 4,
Line 32, please add -- ± -- before 45º

Signed and Sealed this

Third Day of September, 2002

*Attest:*

*Attesting Officer*

JAMES E. ROGAN
*Director of the United States Patent and Trademark Office*